US007192115B2

(12) United States Patent
Kojima

(10) Patent No.: US 7,192,115 B2
(45) Date of Patent: Mar. 20, 2007

(54) IMAGE RECORDING APPARATUS

(75) Inventor: Toshiya Kojima, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 243 days.

(21) Appl. No.: 10/947,238

(22) Filed: Sep. 23, 2004

(65) Prior Publication Data

US 2005/0062776 A1 Mar. 24, 2005

(30) Foreign Application Priority Data

Sep. 24, 2003 (JP) ..... 2003-332469

(51) Int. Cl.
*B41J 29/393* (2006.01)

(52) U.S. Cl. ..... 347/19; 347/13; 347/16

(58) Field of Classification Search ..... None
See application file for complete search history.

(56) References Cited

U.S. PATENT DOCUMENTS 5,430,467 A * 7/1995 Yamaguchi et al. ..... 347/171
5,581,284 A * 12/1996 Hermanson ..... 347/43
6,278,469 B1 * 8/2001 Bland et al. ..... 347/19
6,481,820 B1 11/2002 Tamura et al.

FOREIGN PATENT DOCUMENTS

JP 9-24627 A 1/1997
JP 11-334047 A 12/1999
JP 2002-60072 A 2/2002
JP 2002-331694 A 11/2002
JP 2003-145734 A 5/2003

* cited by examiner

*Primary Examiner*—Lamson Nguyen
(74) *Attorney, Agent, or Firm*—Birch, Stewart, Kolasch & Birch, LLP

(57) ABSTRACT

The image recording apparatus which records an image to a recording medium with a full-line recording head in which a plurality of image-recording elements are arrayed across a length that corresponds to an entire width of the recording medium while at least one of the recording medium and the recording head is conveyed in a direction that is substantially orthogonal to a width direction of the recording medium, and the recording head and the recording medium are relatively moved, the image recording apparatus comprises: a defective pixel detecting device which detects defective pixels in the image recorded on the recording medium by the recording head; a recording medium conveying device which conveys the recording medium on which the defective pixels have been detected, to a position for re-recording the image with the recording head when the defective pixels have been detected in the image recorded on the recording medium; and a defective pixel position detecting device which detects positions of the defective pixels before re-recording the image with the recording head on the recording medium on which the defective pixels have been detected, wherein, when the defective pixels are detected, the defective pixels on the recording medium are restored by moving at least one of the recording head and the recording medium, and re-recording the pixels in the detected defective pixel positions by using different image-recording elements than the image-recording elements that have recorded the defective pixels, or by repairing defects of the image recoding elements which have recorded the defective pixels, and re-recording the image.

7 Claims, 7 Drawing Sheets

IMAGE RECORDING APPARATUS

BACKGROUND OF THE INVENTION

This Non-provisional application claims priority under 35 U.S.C. § 119(a) on patent application Ser. No(s). 2003-332469 filed in Japan on Sep. 24, 2003, the entire contents of which are hereby incorporated by reference.

1. Field of the Invention

The present invention relates to an image recording apparatus, and more particularly, to a technique for restoring recording defects by the image-recording elements of an inkjet recording apparatus or another image recording apparatus for recording images on a recording medium with a recording head having a plurality of image-recording elements.

2. Description of the Related Art

An inkjet image recording apparatus has an inkjet head (print head) in which a plurality of nozzles are arrayed, and the apparatus forms an image on a recording medium by moving the print head and recording medium in relation to each other, while ink is discharged from the nozzles.

In such an inkjet printer, due to clog of nozzles in the print head or a soiled meniscus surface on the ink in the head or other factors, ink may not be discharged or may not be discharged to a proper flight direction, hence missing spots may occur during printing for this reason. Such missing print is inconspicuous due to the considerable overlap in the shuttle-scan method, but nonuniformity by print defects occurs frequently in the case of a line head.

In view of the above, various methods have been proposed to retouch such missing print. Examples of known methods performed using an image recording apparatus for recording images with the dot matrix method (Japanese Patent Application Publication No. 9-24627, for example) include those in which the direction of the recorded medium is reversed while the medium is moved by a prescribed amount with respect to the recording head in the width direction, and the printing defect is retouched so that dot data to be printed is printed using a normally functioning dot print element at a prescribed distance from the defective dot print element in discharging the recorded medium if a printing defect is found. In this case, the prescribed amount is, for example, an integer multiple of the dot spacing, and the recording paper is directly discharged without retouching print defects if there are no print defects.

There are also inventions (Japanese Patent Application Publication No. 11-334047, for example) based on the use of a device for detecting nozzle defects in a linear inkjet, wherein images are formed using an auxiliary head jointly provided to the line head when there are defects in the line head nozzles.

There are further inventions (Japanese Patent Application Publication No. 2003-145734, for example) based on the use of a barcode recording apparatus for discharging ink from a plurality of nozzles disposed in the recording head to record a barcode, wherein a device is provided for detecting defective nozzles in the recording head, and if a defective nozzle is detected, the barcode is recorded so that the recording position of the barcode is shifted, rotated by 90°, or shifted and rotated by 90°.

Nevertheless, as cited in Japanese Patent Application Publication No. 9-24627, the direction of the once printed recorded paper is reversed, print defects are detected, and a determination is made as to whether to reprint, so regardless of the presence of a print defect, and the recording paper always reciprocates through the print head, therethrough productivity is low. Furthermore, only a normally functioning dot print element disposed at a prescribed distance from the defective dot print elements is used for printing, bringing about a drawback whereby the print defects are not necessarily completely retouched due to the skewing or other effect of the recording paper.

In the invention cited in Japanese Patent Application Publication No. 11-334047, there are drawbacks in that the apparatus configuration has considerable redundancy, because a compensating auxiliary head must be jointly provided for each color in addition to a regular line head. In the invention cited in Japanese Patent Application Publication No. 2003-145734, when a defective nozzle is detected, an attempt is made to shift the recording position of the barcode, or rotate the barcode by 90° to avoid streaking or other print defects in advance in the next barcode, and there is no provision for reprinting or taking other remedial action to retouch the recording medium with a print defect, therethrough there is a drawback in that the recording medium printed defectively is wasted

SUMMARY OF THE INVENTION

The present invention has been contrived in view of such circumstances, and an object thereof is to provide an image recording apparatus that can reliably retouch recording defects without wasting the recording medium even if missing print or other recording defects are generated on the recording medium due to nozzle clogging or other image-recording element defects.

In order to attain the above-described object, the present invention is directed to an image recording apparatus which records an image to a recording medium with a full-line recording head in which a plurality of image-recording elements are arrayed across a length that corresponds to an entire width of the recording medium while at least one of the recording medium and the recording head is conveyed in a direction that is substantially orthogonal to a width direction of the recording medium, and the recording head and the recording medium are relatively moved, the image recording apparatus comprising: a defective pixel detecting device which detects defective pixels in the image recorded on the recording medium by the recording head; a recording medium conveying device which conveys the recording medium on which the defective pixels have been detected, to a position for re-recording the image with the recording head when the defective pixels have been detected in the image recorded on the recording medium; and a defective pixel position detecting device which detects positions of the defective pixels before re-recording the image with the recording head on the recording medium on which the defective pixels have been detected, wherein, when the defective pixels are detected, the defective pixels on the recording medium are restored by moving at least one of the recording head and the recording medium, and re-recording the pixels in the detected defective pixel positions by using different image-recording elements than the image-recording elements that have recorded the defective pixels, or by repairing defects of the image recoding elements which have recorded the defective pixels, and re-recording the image.

In accordance with the present invention, defective streaks and spots can be accurately restored because a configuration is adopted in which defective pixels are detected after image recording, only the recording medium on which defective pixels are detected is conveyed to the re-recording position, the defective pixel positions are redetected when recording is performed for a second time, and the defective pixels are restored.

Preferably, pixels surrounding the defective pixels are printed to interpolation when the re-recording is performed on the recording medium with the recording head. More preferably, the pixels surrounding the defective pixels are printed to interpolation with a density that is less than the density during the previous recording. The restored portion can thereby be made more visible.

Preferably, the image recording apparatus further comprises: a relative position varying device which varies relative positions of the recording medium and the recording head in array direction of the image-recording elements when the re-recording is performed on the recording medium with the recording head. Defective pixels can thereby be rapidly restored without carrying out actions to repair the defective image-recording elements.

Preferably, the image recording apparatus further comprises: a discharge unit to which the recording medium having been recorded with the image is discharged; and a standby unit to which the recording medium having been recorded with the image with no defective pixels is discharged, the standby unit being disposed at the discharge unit, wherein the defective pixel detecting device detects defective pixels on an already recorded recording medium, and stores temporarily the recorded recording medium with no defective pixels in the standby unit, whereas restores the recorded recording medium on which defective pixels have been detected, integrates the restored recording medium and the recorded recording medium which stored in the standby unit, and discharges the recorded recording media as a batch.

In accordance with the image recording apparatus related to the present invention as described above, recording defects can be reliably restored without wasting the recording medium even if missing print or other recording defects are generated on the recording medium due to a malfunction of image-recording elements.

BRIEF DESCRIPTION OF THE DRAWINGS

FIG. 5A is an image density graph showing a defective portion, FIG. 5B is a diagram showing a first restoration method for reprinting the defective portion alone, FIG. 5C is a diagram showing a case in which the printing position is slightly displaced by the first restoration method, FIG. 5D is a diagram showing a second restoration method, FIG. 5E is a diagram showing a third restoration method, and FIG. 5F is a diagram showing a case in which the printing position is slightly displaced by the third restoration method;

DETAILED DESCRIPTION OF THE PREFERRED EMBODIMENTS

The image recording apparatus according to the present invention is described in detail below with reference to the accompanying drawings.

Figure 1:
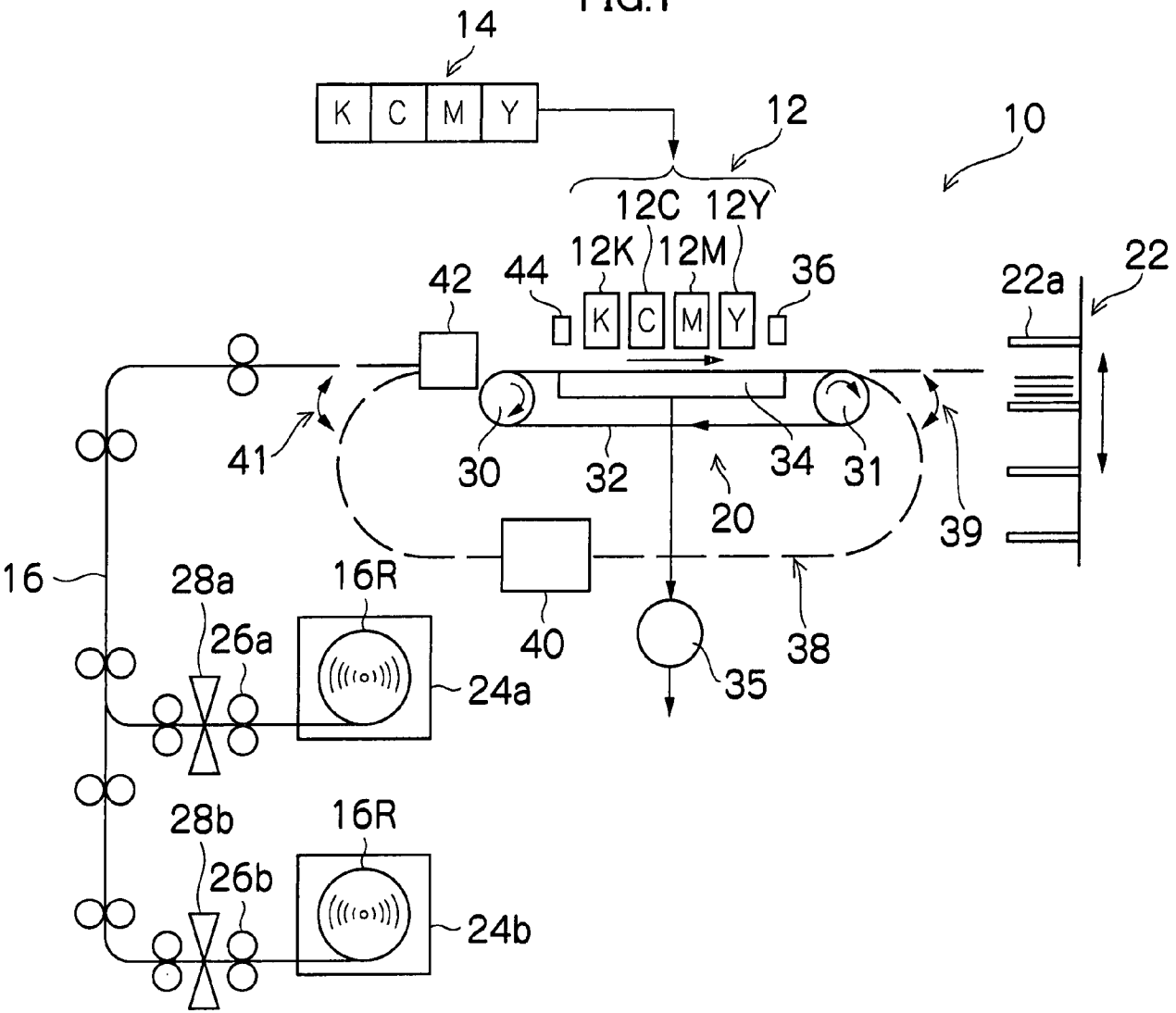
FIG. 1 is a schematic block diagram showing a first embodiment of the image recording apparatus of the present invention.

FIG. 1 is a schematic block diagram showing a first embodiment of the image recording apparatus of the present invention. The image recording apparatus of the first embodiment shown in FIG. 1 is a linear inkjet printer in which a plurality of nozzles (image-recording elements) for discharging ink toward a recoding medium are arrayed in a line, a long recording medium (roll paper) is cut to a prescribed length and a cut sheet is formed in accordance with the print (image) to be formed, and images are created by ink jetting.

As shown in FIG. 1, the image-recording apparatus (inkjet printer) 10 has a printing unit 12 with a plurality of print heads 12K, 12C, 12M, and 12Y provided for each ink color; an ink storing/loading unit 14 for storing ink to be supplied to each of the print heads 12K, 12C, 12M, and 12Y; a paper supply unit 24 for supplying recording paper (recording medium) 16; a suction belt conveyance unit 20 disposed facing the nozzle face (ink discharge face) of the recording unit 12, for conveying the recording paper 16 while keeping the recording paper 16 flat; and a discharge unit 22 for discharging recorded paper (printed matter).

The recording unit 12 is a so-called full-line head in which a line head having a length that corresponds to the maximum paper width is disposed in the direction substantially orthogonal (main scanning direction) to the paper feed direction (sub-scanning direction). The main scanning and sub-scanning directions are precisely defined as follows. By definition, main scanning is a process conducted that when nozzles are driven in a full-line head having a row of nozzles that corresponds to the entire width of the paper, printing may be carried out by (1) simultaneously driving all the nozzles, (2) sequentially driving the nozzles from one side toward the other, (3) dividing the nozzles into blocks and sequentially driving the nozzles in blocks from one side toward the other, or driving the nozzles in another manner to print a single line (a line comprised by a uniserial dot row, or a line comprised by plurality of dot rows) or strip in the width direction of the paper (direction orthogonal to the conveyance direction of the recording paper). The direction indicated by a line or strip (lengthwise direction of the strip area) recorded by main scanning is referred to as the main scanning direction.

In contrast, repeatedly printing one line or strip formed in the course of main scanning by moving the full-line head and the recording paper relative to each other is defined as sub-scanning. The direction in which sub-scanning is conducted is referred to as the sub-scanning direction. In short, the conveyance direction is the sub-scanning direction, and the direction orthogonal thereto is referred to as the main scanning direction.

A description of a specific structural example is omitted, but each of the recording heads 12K, 12C, 12M, and 12Y is composed of a line head in which a plurality of ink discharge ports (nozzles) are arrayed across a length that exceeds at least one side of the maximum-size recording paper 16 intended for use in the inkjet recording apparatus 10.

The recording head 12 is configured such that the recording heads 12K, 12C, 12M, and 12Y corresponding to each color of ink are disposed in order of black (K), cyan (C), magenta (M), and yellow (Y) from the upstream side along the feed direction (paper conveyance direction) of the recording paper 16 indicated by an arrow in the diagram. A color image can be formed on the recording paper 16 by discharging ink from each of the print heads 12K, 12C, 12M, and 12Y while the recording paper 16 is being conveyed.

Thus, with the recording unit 12 in which a full-line head that covers the entire width of the paper is provided for each ink color, an image can be recorded across the entire surface of the recording paper 16 by performing the action of moving the recording paper 16 and recording unit 12 in relation to each other in the sub-scanning direction just once (in other words, with one sub-scan). High-speed recording is thereby made possible in comparison with a shuttle type head in which the print head reciprocates in the main scanning direction of the recording head, and productivity can be improved.

The example shown in the diagram is a configuration with the standard colors of K, C, M, and Y (four colors), but combinations of the ink color and the number of colors are not limited by the present embodiment, and light inks and dark inks may be added as required. A configuration in which recording heads for discharging light cyan, light magenta, and other light-colored inks are added is also possible, for example.

The ink storing/loading unit 14 has tanks for storing ink with colors corresponding to each of the recording heads 12K, 12C, 12M, and 12Y, and each tanks are in communication with each of the recording heads 12K, 12C, 12M, and 12Y via a conduit.

The recording paper 16 is supplied from the paper supply unit 18. Shown in FIG. 1 as the paper supply unit 18 are magazines 24*a* and 24*b* loaded with roll paper (continuous paper) 16R in which recording paper 16 is wound in the form of a roll, but also possible is the use of roll paper 16R of varying width, paper quality, and other attributes loaded into these magazines 24*a* and 24*b*. Recording paper 16 may also be supplied from a cassette in which cut paper is loaded in a stack. This option may be used instead of or together with the magazines 24*a* and 24*b* for roll paper 16R. When cut paper is used, the cassette is disposed between cutters 28*a* and 28*b* and the recording unit 12. The magazines 24*a* and 24*b* are not limited to two, and it is possible to use a single magazine or more than two magazines.

Also provided are draw-out rollers 26*a* and 26*b* for drawing out recording paper 16 from the magazines 24*a* and 24*b*, respectively, and cutters 28*a* and 28*b* whereby the recording paper 16 drawn out from the magazines 24*a* and 24*b* is cut to a prescribed length. When using cut paper, the cutters 28*a* and 28*b* are not required. The recording paper 16 that has been drawn out from the magazines 24*a* and 24*b* by the draw-out rollers 26*a* and 26*b*, and cut to a prescribed length by the cutters 28*a* and 28*b* is delivered to the suction belt conveyance unit 20 by a recording paper conveyance unit having several rollers.

The suction belt conveyance unit 20 has a configuration in which an endless belt 32 is set around rollers 30 and 31, and in which the portion facing at least the nozzle face of the recording unit 12 forms a horizontal plane (flat plane). The belt 32 has a width that is greater than the width of the recording paper 16, and a plurality of suction holes are formed in the belt surface. A suction chamber 34 is disposed in a position facing the nozzle surface of the printing unit 12 on the interior side of the belt 32 that is set around the rollers 30 and 31, this suction chamber 34 provides suction with a suction fan 35 to create a negative pressure, and the recording paper 16 on the belt 32 is held to the belt 32 by suction.

The discharge unit 22 has a plurality of shelves 22*a* and is configured with a so-called sorter that moves up and down, as indicated by the arrow in the diagram, and sorts and stores the recorded paper 16 into the shelves 22*a* for each order (for each project), for example. In this case, a single order is a unit or project ordered by a customer, and each unit is a single roll of photographic film that has 20 images or another number of frames, for example. In the present embodiment, the discharge unit 22 is configured so as to double as a standby unit in which recorded paper is temporarily stored. The image recording apparatus (inkjet printer) 10 of the present embodiment, in addition to the regular configuration as described above, is provided with the characteristic configuration of the present invention as described below.

In other words, a defective pixel detection device 36 for detecting the presence of defective pixels in an image recorded on the recording paper 16 is provided to the recording unit 12 on the downstream side in the conveyance direction of the recording paper 16 indicated by the arrow in the diagram. The defective pixel detection device 36 is not particularly limited as long as defective pixels can be detected. A non-discharge detection device for detecting whether ink has been discharged from the nozzles immediately after recording may be provided, or the recorded image may be read with a line sensor, and defective nozzles may be determined from the missing print in the image.

A single defective pixel detection device 36 may be provided to the entire set of recording heads 12K, 12C, 12M, and 12Y as shown in the diagram, or to each one of the recording heads 12K, 12C, 12M, and 12Y.

When no defective pixels have been detected in this case, the satisfactorily recorded paper 16 is directly placed on one of the shelves 22*a* of the discharge unit (sorter 22) and is temporarily stored until the processing for the order that contains the recorded image is completed. Thus, the discharge unit (sorter) 22 includes a standby unit for satisfactorily recorded paper 16 in which defective pixels have not been detected. The discharge unit 22 is not necessarily required to double as the standby unit, and the standby and discharge units may naturally serve as separate units.

After recording, the recording paper 16 in which defective pixels have been detected is restored by recording the defective pixels a second time in order to avoid wasting recording paper 16. Provided in such a case is a conveyance device 38 for re-conveying the recording paper 16 with defective pixels to the recording unit 12. The conveyance device 38 is configured so that when the defective pixel detection device 36 detects defective pixels, a detection signal is received, the conveyance direction of the recording paper 16 is changed by a conveyance pathway switching device 39, and the recording paper 16 in which defective pixels have been detected is re-conveyed to the recording unit 12.

The conveyance pathway through which the conveyance device 38 conveys the recording paper 16 to the recording unit 12 may be configured as an entirely separate pathway from the conveyance pathway used during normal recording, or may be configured such that the recording paper 16 passes under the recording head so as to be conveyed in the reverse direction of the conveyance pathway during recording. When the number of sheets of recording paper 16 in which defective pixels have been detected is considerable, a buffer 40 may be provided in an intermediate position in the conveyance pathway of the conveyance device 38 in order to reduce the processing load imposed on the recording unit 12 by returning these sheets to the recording unit 12 all at once, and the recording paper 16 to be returned to the recording unit 12 is temporarily stocked therein.

A conveyance pathway switching device 41 is provided in a stage prior to the recording unit 12. The conveyance pathway switching device 41 is a device for inserting recording paper 16 conveyed to the recording unit 12 by the conveyance device 38 into the conveyance pathway during re-recording. A relative movement direction-changing device 42 for changing the direction of relative movement of the recording paper 16 with respect to the recording heads 12K, 12C, 12M, and 12Y, inserted into the conveyance pathway during recording by the conveyance switching device 41, is provided in a stage prior to the recording unit 12 in the same manner.

When the recording paper 16 is moved relative to the recording head 12K, 12C, 12M, and 12Y in the same manner as in the previous cycle, the defective pixels are recorded a second time by the same defective nozzles as in the previous cycle, and the defective pixels are thereby left unrestored. In view of the above, the relative movement direction-changing device 42 changes the relative movement direction of the recording paper 16 with respect to the recording head 12K, 12C, 12M, and 12Y, and the defective pixels are restored by recording the defective pixels with different nozzles than in the previous cycle.

The preceding stage of the recording unit 12 is provided with a defective pixel position detection device 44 for detecting the position of defective pixels on the recording paper 16 with defective pixels that require re-recording. The defective pixel position detection device 44 may, for example, be one that reads a recorded image with a line sensor and determines the position of defective nozzles from the missing print in the image, as is the case with the defective pixel detection device 36 described above. Defective pixel positions can thereby be accurately ascertained, and image data can be converted in accordance therewith and recorded so that defective pixels can be reliably restored in the recording unit 12.

The recording paper 16 for which defective pixels have been restored in this manner is sent to the discharge unit (sorter) 22. The restored recording paper 16 is brought together in the discharge unit 22 with recorded paper 16 that belongs to the same order and is stored in the discharge unit 22, and these two types of paper are discharged together as a single order.

Figure 2:
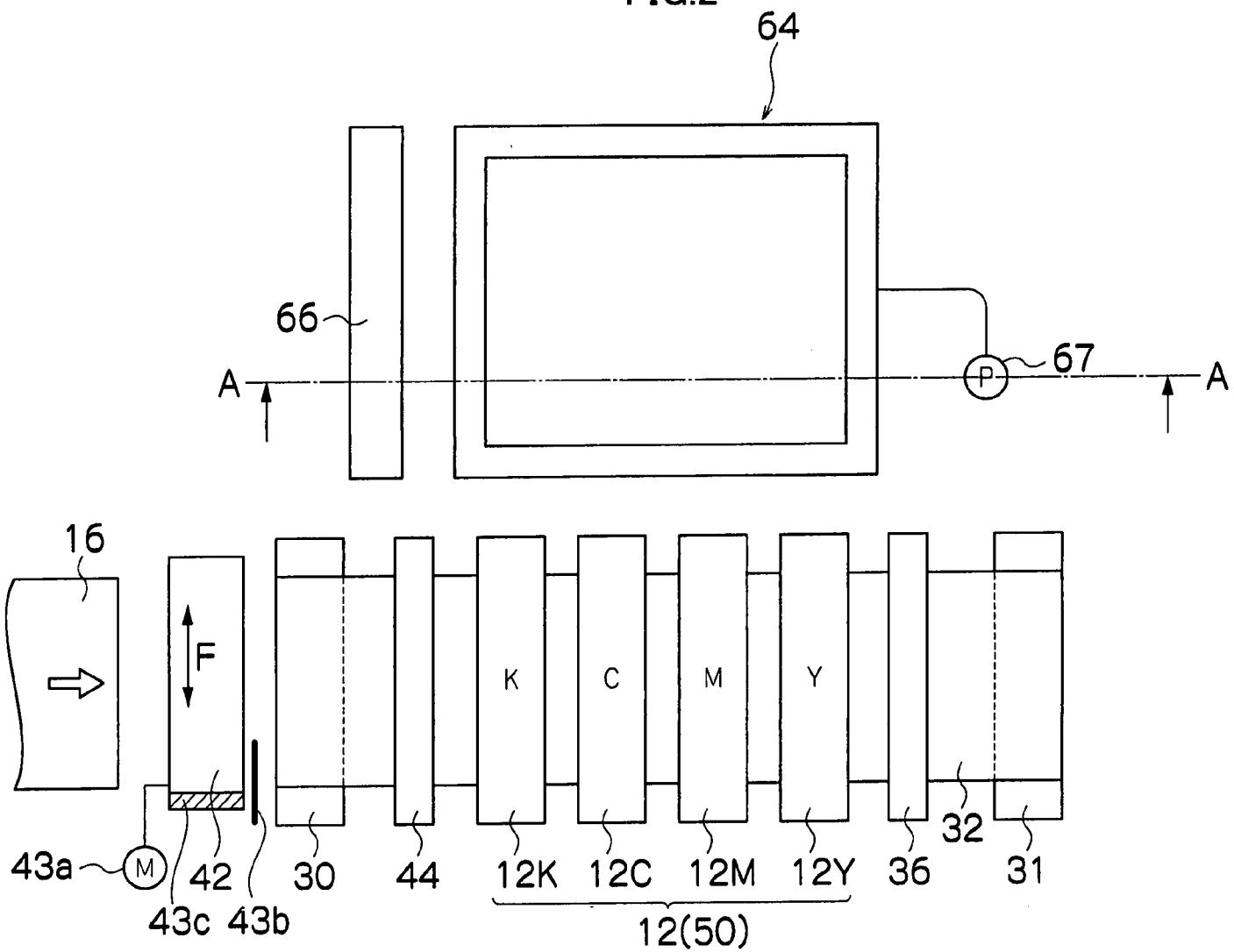
FIG. 2 is a plan view showing neighborhood the recording unit in FIG. 1.

FIG. 2 is a plan view showing neighborhood the recording unit 12. Each of the print heads 12K, 12C, 12M, and 12Y is composed of a full-line head, in which a plurality of ink-droplet ejection apertures (nozzles) are arranged along a length that exceeds at least one side of the maximum-size recording paper 16 intended for use in the inkjet recording apparatus 10, as shown in FIG. 2.

Additionally, as a device for restoring defective pixels of image-recording elements, a maintenance unit which comprised a cap 64, a blade 66, and the like, is arranged on the position which is not same of print heads 12K (12C, 12M, and 12Y) on the side of the belt 32, the print heads 12K (12C, 12M, and 12Y) are moved toward the position of the maintenance unit when restoring, and the defective pixels can be restored by wiping the print heads 12K (12C, 12M, and 12Y, hereinafter referred to as the print heads symbol "50") with blade 66, or by sucking the ink from the print heads 50.

Furthermore, the cap 64 can be used in common with all colors, and can be used separately to each of colors.

A defective pixel position detection device 44 is disposed in a stage prior to the print heads 50, and a relative movement direction-changing device 42 is disposed in a stage prior to the defective pixel position detection device 44. As indicated by the arrow F in the diagram, the relative movement direction-changing device 42 is moved toward approximately verticality of the conveyance direction of the recording paper 16, and is changed the direction of relative movement of the recording paper 16.

As a device for moving the relative movement direction-changing device 42, example of combination with a motor 43*a*, a linear scale 43*b*, and a linear scale detecting element 43*c*, may position with precision. By means of the combination, since the recording paper 16 can be moved toward the conveyance direction and the verticality direction, recording can be performed by image-recording elements that are different to last time, and hence it is possible to restore the defective pixel certainly.

Figure 3:
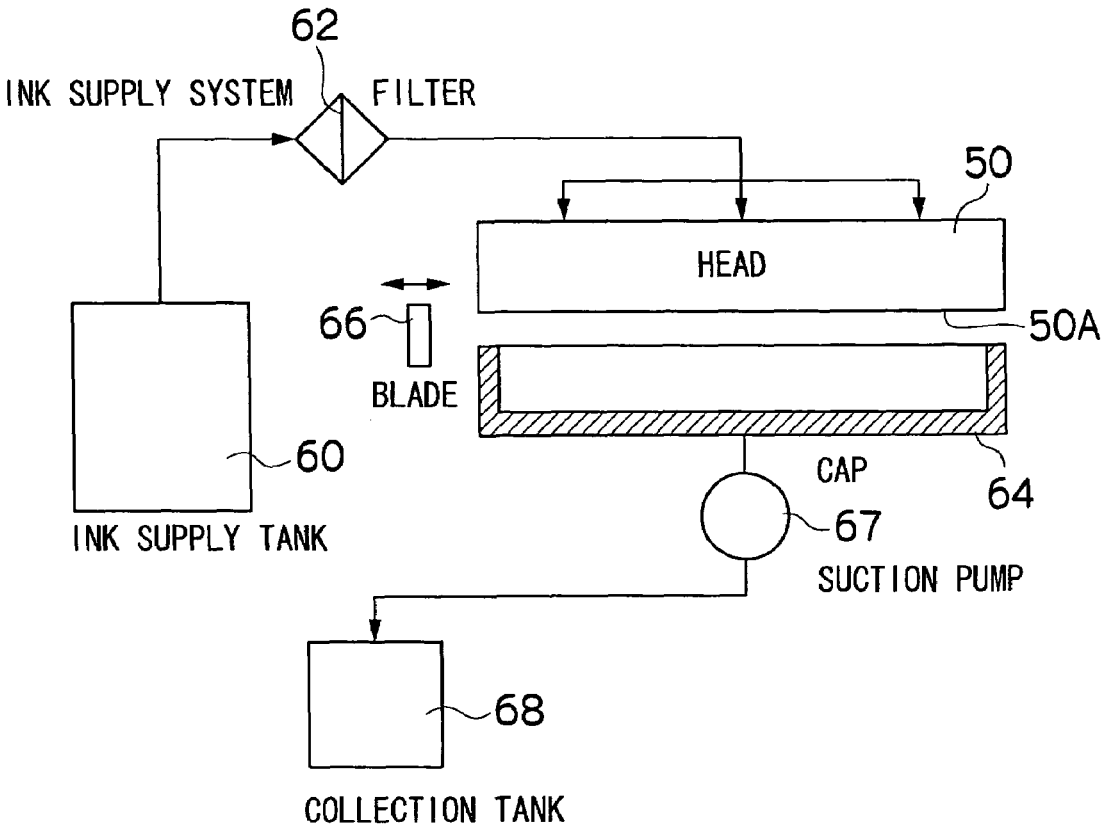
FIG. 3 is a cross-sectional view showing the maintenance unit taken along the line 4—4 in FIG. 2, and is a schematic drawing showing the configuration of the ink supply system.

FIG. 3 is a cross-sectional view showing the maintenance unit taken along the line 4—4 in FIG. 2, and is a schematic drawing showing the configuration of the ink supply system.

Figure 6:
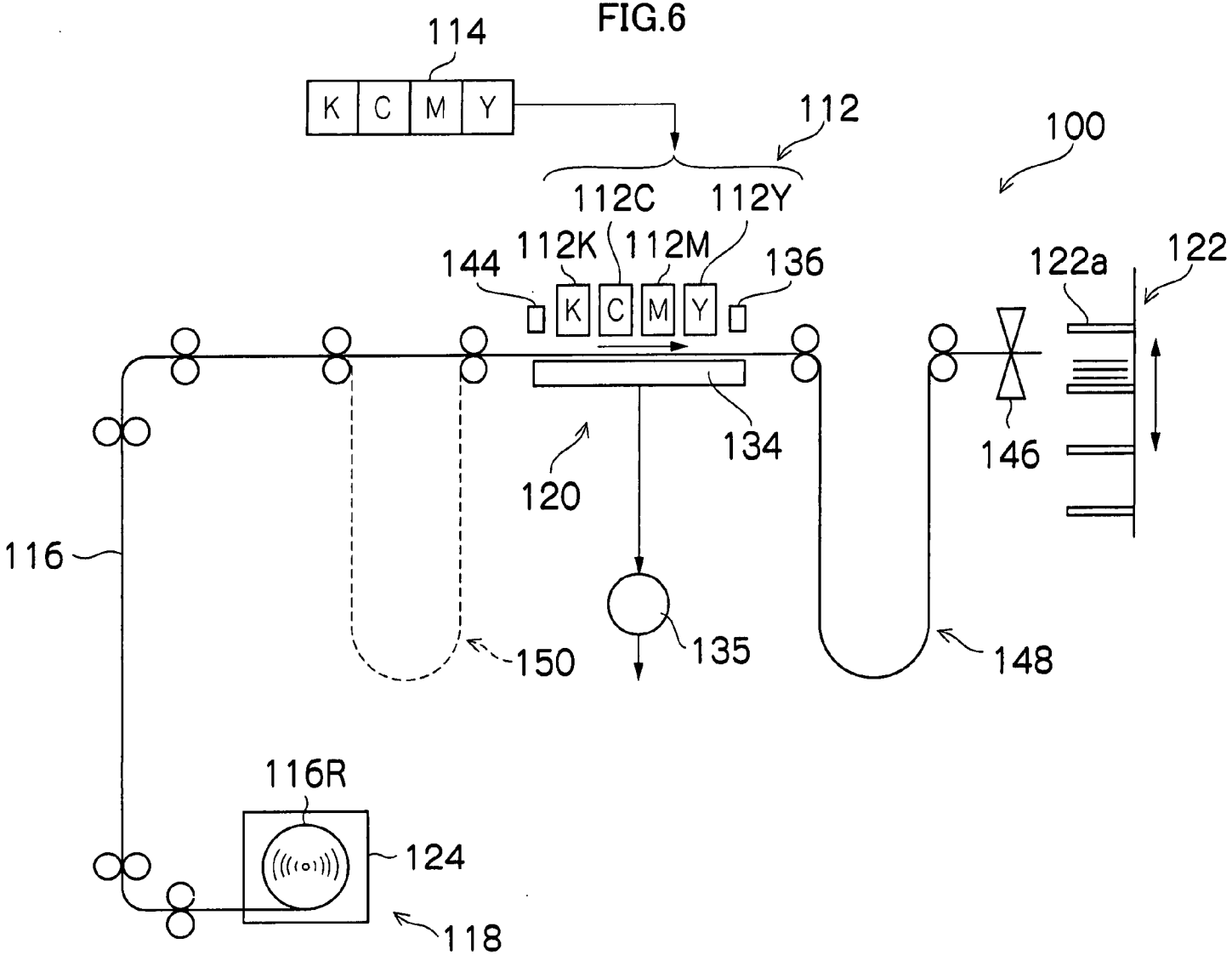
FIG. 6 is a schematic block diagram showing a second embodiment of the image recording apparatus of the present invention.

In FIG. 3, an ink supply tank 60 is a base tank that supplies ink and is set in the ink storing/loading unit 14 described with reference to FIG. 1. The aspects of the ink supply tank 60 include a refillable type and a cartridge type: when the remaining amount of ink is low, the ink supply tank 60 of the refillable type is filled with ink through a filling port (not shown) and the ink supply tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink supply tank 60 in FIG. 6 is equivalent to the ink storing/loading unit 14 in FIG. 1 described above.

As shown in FIG. 3, a filter 62 for removing foreign matters and bubbles is disposed between the ink supply tank 60 and the print head 50. The filter mesh size in the filter 62 is preferably equivalent to or less than the diameter of the nozzle (commonly about 20 μm).

Although not shown in FIG. 3, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 64 as a device to prevent a nozzle of the print head 50 from drying out or to prevent an increase in the ink viscosity in the vicinity of the nozzles, and a cleaning blade 66 as a device to clean the ink discharge face of the nozzle.

The maintenance unit including the cap 64 and the cleaning blade 66 can be moved in a relative fashion with respect to the print head 50 by a movement mechanism (not shown), and is moved from a predetermined holding position to a maintenance position below the print head 50 as required.

The cap 64 is displaced up and down in a relative fashion with respect to the print head 50 by an elevator mechanism (not shown). When the power of the inkjet recording apparatus 10 is switched OFF or when in a print standby state, the cap 64 is raised to a predetermined elevated position so as to come into close contact with the print head 50, and the ink discharge face of the nozzle is thereby covered with the cap 64.

The cleaning blade 66 is composed of rubber or another elastic member, and can slide on the ink discharge surface (surface of the nozzle plate) of the print head 50 by means of a blade movement mechanism (wiper, not shown). When ink droplets or foreign matter has adhered to the nozzle plate, the surface of the nozzle plate is wiped, and the surface of the nozzle plate is cleaned by sliding the cleaning blade 66 on the nozzle plate.

During printing or standby, when the frequency of use of specific nozzles is reduced and ink viscosity increases, a preliminary discharge is made toward the cap to which the degraded ink by increased viscosity is to be discharged.

Also, when bubbles have become intermixed in the ink inside the print head 50 (inside a pressure chamber), ink can no longer be discharged from the nozzle even if an actuator is operated. The cap 64 is placed on the print head 50 in such a case, ink (ink in which bubbles have become intermixed) inside the pressure chamber is removed by suction with a suction pump 67, and the suction-removed ink is sent to a collection tank 68. This suction action entails suctioning of degraded ink whose is hardened by increase of viscosity when initially loaded into the head, or when service has started after a long period of being stopped.

More specifically, when no ink is discharged from the nozzles of the print head 50 over a certain amount of time, the ink solvent near the nozzles evaporates, the viscosity of the ink near the nozzles increases, and ink cannot be discharged from the nozzles even when the actuator operates. Therefore, before such circumstances occur (while the viscosity allows the possibility of discharge by the actuator), the actuator is operated to receive the ink, and "preparatory discharge" is performed, in which the ink near the nozzles with increased viscosity is discharged. Also, after stains on the nozzle surface are washed off by a cleaning blade or another such wiper (not shown) provided as a washing device for the nozzle surface, a preparatory discharge is performed to prevent impurities from getting mixed in the nozzle due to the rubbing operation of the wiper. The preparatory discharge is also sometimes referred to as "empty discharge," "purging," "liquid discharge," or the like.

Additionally, when the increasing viscosity of the ink in the nozzles exceeds a certain level, the suction operation described above is performed because the ink cannot be discharged by the above-mentioned preparatory discharge.

Specifically, when air bubbles become mixed in the nozzles and in the ink in the pressure chambers, the ink cannot be discharged form the nozzles even when the actuator operates. The ink cannot be discharged form the nozzles even when the actuator operates also when the viscosity of the ink in the nozzles exceeds a certain level. In such a case, a suction device for drawing out the ink in the pressure chambers with a pump or the like is provided to the nozzle surface 140, and bubbled or thickened ink is suctioned out. In such a case, a suction device for drawing out the ink in the pressure chambers 52 with a pump or the like is provided to the nozzle surface 140, and bubbled or thickened ink is suctioned out.

However, the suction operation described above consumes a large amount of ink because it is performed for all the ink in the pressure chambers. Therefore, it is preferable to perform the preparatory discharge, if possible, when the increase in viscosity is low.

Additionally, it is preferable that inside of the cap 64 is partitioned by party walls into the a number of areas in accordance with nozzle row, and that the maintenance unit has a configuration which each areas partitioned those walls can be suctioned selectively by selectors, and the like. By the performance of above maintenance unit, defective nozzle (image-recording elements) is restored.

The effect of the first embodiment is described below in accordance with the steps shown in the flowchart FIG. 4.

Figure 4:
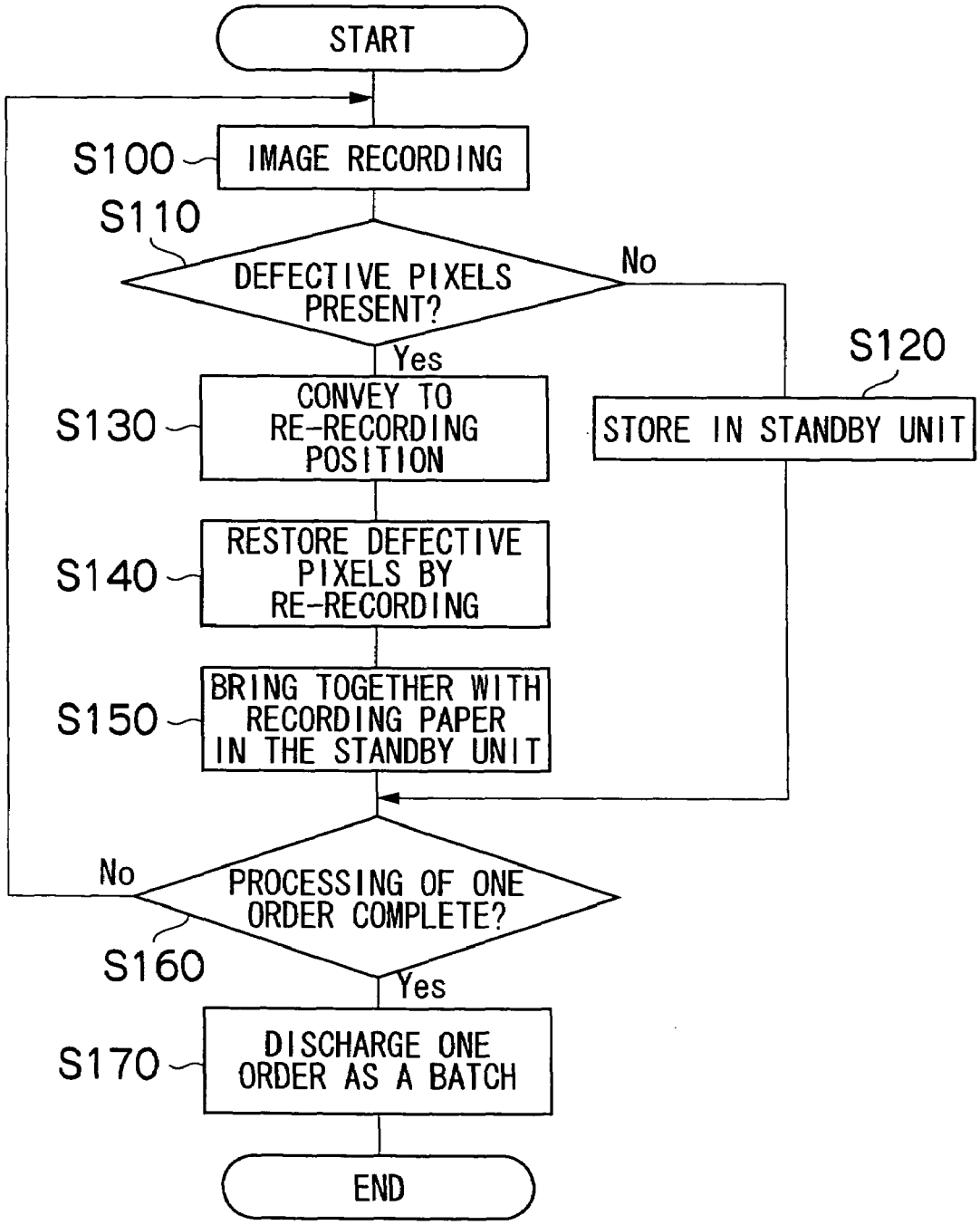
FIG. 4 is a flowchart showing the processing flow for restoring defective pixels as an effect of the image recording apparatus of the first embodiment.

FIG. 4 is a flowchart showing the processing flow for restoring defective pixels as an effect of the image recording apparatus 10 of the present embodiment. The flowchart in FIG. 4 shows the processing of a single order, and in the actual work process it is commonplace to process a plurality of orders, so even if processing for a single order is completed, overall processing may not be complete and the processing shown the FIG. 2 may be repeatedly executed.

The first embodiment is one in which the first recording cycle is conducted on cut paper (sheets), and defective pixels are detected each time an image (frame) is recorded in the order. When there are no defects, the recorded paper is stored in the standby unit, and when defects have been detected, the recorded paper is returned to the recording unit 12, defective pixels are restored by recording the defective pixels a second time with nozzles that are different from those used during the first recording, the restored recording paper is brought together with recording paper stored in the standby unit, and the single order is discharged as a batch.

First, image recording is carried out in step S100 of FIG. 4. Image recording entails drawing out roll paper 16R in the magazine 24*a* (or 24*b*) of the paper supply unit 18 with the draw-out roller 26*a* (or 26*b*), cutting the paper into cut paper (sheets) with a prescribed length with the cutter 28*a* (or 28*b*) in accordance with the image size, and conveying the paper to the recording head 12 with a plurality of conveyance rollers. The relative movement direction-changing device 42 and defective pixel position detection device 44 do not operate in the first recording cycle. The recording paper 16 in the form of a sheet conveyed to the recording unit 12 is transported under the recording heads 12K, 12C, 12M, and 12Y while kept flat and held to the belt 32 by the suction belt conveyance unit 20, and an image is recorded by the recording heads 12K, 12C, 12M, and 12Y.

Next, in step S110, a determination is made as to whether there are defective pixels. The determination involves a process in which the recording paper 16 conveyed while being held flat by the suction belt conveyance unit 20 is inspected with the defective pixel detection device 36.

If defective pixels have not been detected by the determination of step S110, the process advances to step S120, and the adequately recorded paper 16 that is devoid of defective pixels is stored in the standby unit. In the present embodiment, the conveyance unit (sorter) 22 also serves to function as the standby unit, so recording paper is stored on a prescribed shelf 22*a* of the conveyance unit 22.

If defective pixels have been detected by the determination of step S110, the recording paper 16 with defective pixels is conveyed to the recording unit 12 in order to be recorded with images a second time in the step S130. In other words, when the defective pixel detection device 36 detects defective pixels, the conveyance pathway switching device 39 is actuated, and the recording paper 16 with defective pixels is brought into the conveyance pathway of the conveyance device 38 for conveying the recording paper to the recording unit 12.

The recording paper 16 with defective pixels is conveyed to the recording unit 12 in order to be recorded a second time with respect to the defective pixels. The paper may be stocked as needed in the buffer 40 provided in an intermediate position of the conveyance device 38. The conveyance device 38, while ensuring timing with the image recording of the next recording paper 16 in the recording unit 12, conveys the recording paper 16 toward the recording unit 12, and the recording paper 16 to be recorded a second time is conveyed to the relative movement direction-changing device 42 by the conveyance pathway switching device 41.

Next, defective pixels are restored in step S140 by being recorded a second time in the recording unit 12. In other words, the relative movement direction-changing device 42 changes the relative movement direction of the recording paper 16 to be recorded a second time to a direction that is different from the first movement direction, and the defective pixels are recorded with nozzles that are different from those used during the first recording when the recording paper 16 is conveyed under the recording head 12K, 12C, 12M, and 12Y by the suction belt conveyance unit 20.

When passing under the recording head 12K, 12C, 12M, and 12Y a second time, for example, the recording paper 16 is conveyed in such a manner that the amount of skew applied to the recording paper 16 with respect to the conveyance direction is different than the angle used during the previous recording cycle to allow reparative recording (printing) to be carried out with different nozzles. In this case, a rotation of 90°, or 180°, for example, may be used as the different angle of rotation.

In this case, the defective pixel positions on the recording paper 16 can be accurately detected by the defective pixel position detection device 44 disposed immediately in front of the recording heads 12K, 12C, 12M, and 12Y, and the defective pixels reliably can be restored.

A detection signal is received from the defective pixel position detection device 44, and interpolative recording (interpolative printing) may be carried out in the recording unit 12 with respect to the pixels surrounding the defective pixels (a range of ±1 to ±5 pixels with respect to the defective pixels). The pixels surrounding a defective pixel may be recorded by interpolation such that the density becomes less than that provided during the previous recording cycle as the distance from the defective pixel position increases. Alternatively, the pixels surrounding a defective pixel may be broadly recorded with a uniform density that is less than the density used when recording the defective pixel. The image may also be recorded with dots that are smaller than the dots used in the original image, for example, as a method of reducing the density.

Figure 5A:
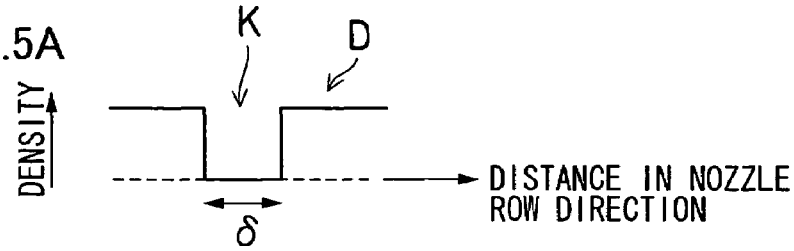
FIGS. 5A to 5F are diagrams for describing the method for restoring defective pixels.

The method for re-recording defective pixels to restore defective portions is described in detail below with reference to the diagrams. FIG. 5A is a graph D of the image density around defective pixels. In this graph D, horizontal axis represents the distance in the nozzle row direction (main scanning direction), and the vertical axis represents the image density. Thus, the defective pixel portion K is not printed in a width d equivalent to a single pixel or several pixels.

Figure 5B:
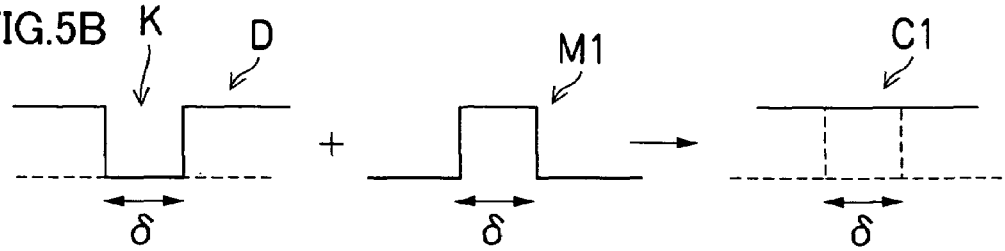
Figure 5C:
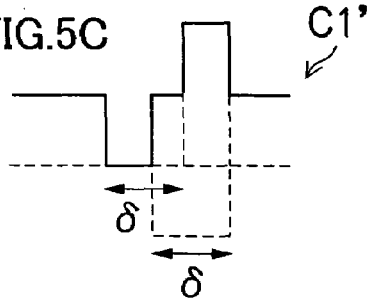

In contrast, the first restoration method is a method for reprinting solely in a defective portion. The graph C1 of a correctly restored image is obtained by a process in which the image pattern M1 that has the same density as the original recorded image is accurately recorded in the defective portion in an amount equivalent to the width d, as shown in FIG. 5B. In this case, however, printing must be accurately carried out within the width of the defective pixels, but it is difficult to accurately print solely to the positions of the defective pixels in this manner, and in practice, as shown in FIG. 5C, it is possible that displacement may occur by a slight distance, resulting in the graph C1'. However, even with a small amount of this type of displacement, the frequency is such that a change in density cannot be distinguished, so the result appears to be uniform based on visual observation, and there is likely no drawback in the visual appearance.

Figure 5D:
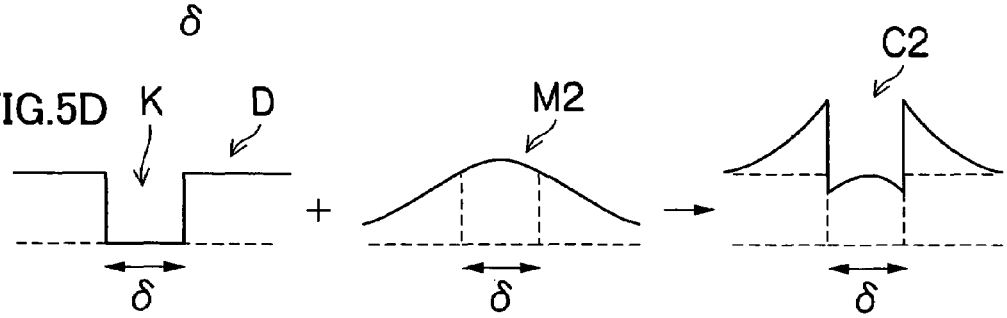

The second restoration method is a method for recording a second time the pattern M2 that has a peak in the defective portion d, as shown in FIG. 5D, so as to allow the reprinting position to be slightly displaced. In practice, the pattern M2 is not smooth in the manner shown, but is a stepped (discrete) pattern that reflects the density value of each pixel. As a result of this, a density graph of the restored image such as graph C2 is obtained. In this case, restoration is possible even if the printing position is slightly displaced, and allowable width is greater than that obtained by the fist restoration method.

Figure 5E:
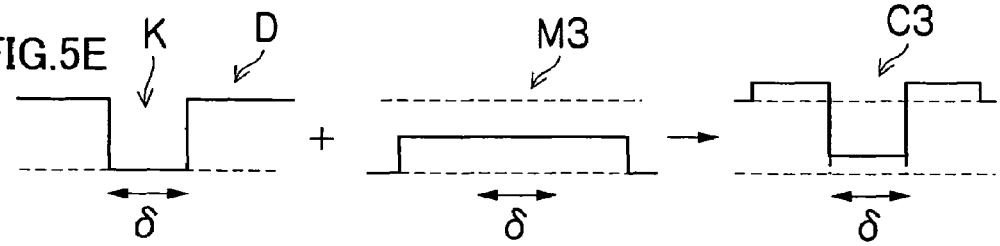
Figure 5F:
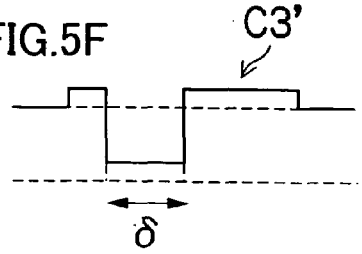

According to a third restoration method, the defective portion is reprinted with an image pattern M3 whose density is uniformly less than that of the previous cycle. The portion is reprinted across a prescribed range that includes the defective portion d; for example, a range that is three times the defective portion d, as shown in FIG. 5E. Defects may be visually observed if the image pattern M3 is too wide, so in practice the width of the defective portion is preferably two to five times greater. The density graph C3 of the restored image can be obtained by overlaying and recording the image pattern M3 on this defective portion. In this case, the graph C3' shown in FIG. 5F is the result of a slight displacement in the printing position of the image pattern M3, but the defect is difficult to visually observe, and there is no particular problem.

Thus, there are various methods for restoring defects by reprinting, but the first method is most preferable as long as recording can be accurately performed. However, it is difficult to perfectly match the recording position in this manner, so it is possible to adequately restore defects with the second and third methods as well. There is also no particularly visible difference between the second and third methods.

After the defective pixels have been re-recorded, the recording paper 16 for which restoration has been completed may be sent to the discharge unit 22 without being inspected by the defective pixel detection device 36. When the restored recording paper 16 is inspected again by the defective pixel detection device 36 and defective pixels are found again, the recording paper 16 may be returned to the recording unit 12 yet again, and defective pixels may be restored with a different method than the one used in the previous attempt.

When the restoration of defective pixels is complete, the restored recording paper 16 that has been sent to the discharge unit 22 is conveyed to the same shelf 22*a* as the adequately recorded paper 16 that is devoid of defective pixels, is from the same order, and is stored on the shelf, and the two types of paper are brought together in step S150.

Next, in step S160, a determination is made as to whether processing for the single order is complete. This method is not particularly limited, for example, it is possible to count the number of image frames in the order in advance, and to count the number of sheets of recording paper 16 conveyed to the discharge unit 22 to make the determination. When the order has not been completed, the process returns to step S100, and the above processing is repeated.

When the processing of a single order has been completed, the recorded paper 16 that belongs to the single order and is brought together as a batch in one of the shelves 22*a* of the discharge port 22 is discharged in the next step S170. The recording paper 16 on which the images of a single order are recorded is brought together as a batch without becoming disordered, and is discharged in a correctly ordered fashion.

In above example, the direction of relative movement of the recording paper and the recording head during re-recording is changed to a different direction than the movement direction during the first recording, and defective pixels are recorded with different nozzles than those used during the first recording, but the method of restoring defective pixels is not limited to this option alone.

For example, in the case of a line head, the position of the recording paper being conveyed to the recording head during re-recording may be moved (shifted) by a distance that is equivalent to several nozzles in the direction perpendicular (main scanning direction) to the conveyance direction. In accordance therewith, defective pixels are recorded with nozzles that are separated by several nozzles from the defective nozzles, so the defective pixels can be restored.

The conveyance direction of the recording paper during the first and second recordings may not be the same direction, for example. In other words, the second recording may be carried out by returning the recording paper so that the paper passes under the recording head in the reverse direction in an unaltered state, and the image as the paper may be re-recorded while being returned. In this case, the portion with the defective pixels is recorded with the same nozzles as the previous cycle, so restorative action to the nozzles must be conducted prior to recording a second time.

To perform restorative action to the nozzles when defective pixels have been detected, a method may be adopted whereby the recording paper is returned, restorative action is performed on the defective nozzles, and the defective pixels are re-recorded with same nozzles after they have been restored while the paper is conveyed in the same manner as during the first recording. In such a case, restorative action for the nozzles must be performed, so extra maintenance time is required, but the advantages are that the recording paper may simply be returned and conveyed in the same manner, a sensor for changing the direction of relative movement and for detecting defective pixel positions is not particularly required.

Next, the second embodiment of the present invention is described.

FIG. 6 is a schematic block diagram showing a second embodiment of the image recording apparatus of the present invention. The image recording apparatus of the second embodiment shown in FIG. 6 performs the first image recording directly to the roll paper (continuous paper), detects defective pixels for each image frame after the images have been recorded, forms a loop portion of uncut paper in standby until the processing of a single order is completed, returns the recording paper of a single order before the next order is processed when defective pixels have been detected, forms a loop portion in front of the recording unit, records solely the images with defective pixels, and cuts the paper with the images (frames) of a single order as a batch.

In other words, as shown in FIG. 6, the image-recording apparatus 100 has a printing unit 112 with a plurality of print heads 112K, 112C, 112M, and 112Y provided for each ink color; an ink storing/loading unit 114 for storing ink to be supplied to each of the print heads 112K, 112C, 112M, and 112Y; a paper supply unit 118 for supplying recording paper (recording medium) 116; a suction unit 120 disposed facing the nozzle face (ink discharge face) of the recording unit 112, for holding the recording paper 116 flat; and a discharge unit 122 for discharging recorded paper (printed matter) 116.

The constituent elements thereof are fundamentally substantially the same as those in the above first embodiment. In the present embodiment, however, image recording is performed directly on roll paper, so there are a number of points of difference. For example, the paper supply unit 118 does not have a cutter for cutting the recording paper 116 to a prescribed length after the recording paper 116 is drawn out from the magazine 124 because the paper is directly handled as roll paper. Additionally, the image recording apparatus 100 of the present embodiment processes the images (frames) of a single order as a batch, so loop portions 148 and 150 are formed for holding the images (frames) of a single order until the processing of the single order is complete.

In the present embodiment, the recording paper 116 is conveyed by a plurality of conveyance rollers in the form of a continuous roll, so the suction unit 120 is provided with a suction chamber 134 for holding flat the recording paper 116 in the form of a roll, and a suction fan 135 for suctioning the suction chamber 134 to create negative pressure. Disposed immediately after the recording unit 112 is a defective pixel detection device 136 for detecting defective pixels after image recording, and a defective pixel position detection device 144 for detecting a second time the position of defective pixels just prior to recording for restoring defective pixels.

A loop portion 148 for accumulating images (frames) from a single order is formed in the stage following the recording unit 112, and a loop portion 150 for returning and holding the images for a single order when recording for a second time is formed in a stage prior to the recording unit 112. In other words, in the present embodiment, the loop portion 148 corresponds to a standby unit. Also provided is a cutter 146 for cutting each order as a batch, and a discharge unit 122 for holding recorded images from each order after the processing of a single order is complete. In the same manner as the first embodiment, the discharge unit 122 has a plurality of shelves 122*a* for storing images for each order, moves up and down as shown in the diagram, and stores the recording paper 116 that has been cut for each image (frame).

The effect of the second embodiment is described below with reference to the flowchart in FIG. 7.

Figure 7:
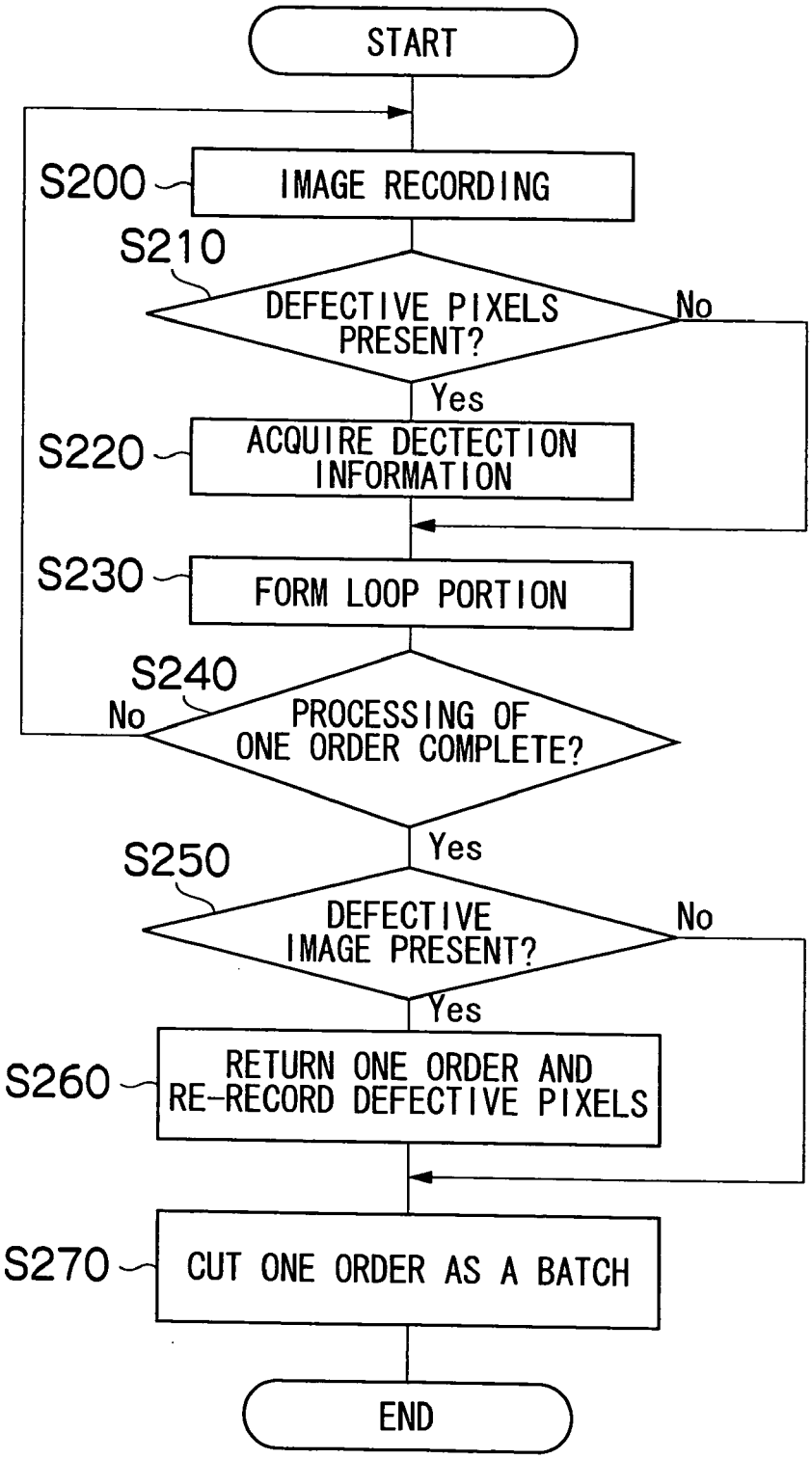
FIG. 7 is a flowchart showing the processing flow for restoring defective pixels as an effect of the image recording apparatus of the second embodiment.

FIG. 7 is a flowchart showing the processing flow for restoring defective pixels as an effect of the image recording apparatus 100 of the second embodiment. The flowchart in FIG. 7 shows only the processing of a single order, in the same manner as the flowchart in FIG. 4.

First, an image is recorded in step S200. Recording an image entails drawing out roll paper 116R from the magazine 124 of the paper supply unit 118, and conveying the recording paper 116 in a continuous state to the recording head 112 with a plurality of conveyance rollers. The defective pixel position detection device 144 does not operate in the first recording cycle. The recording paper 116 conveyed to the recording unit 112 in a continuous form is suctioned and kept flat by the suction chamber 134 of the suction unit 120 while conveyed under the recording heads 112K, 112C, 112M, and 112Y, and images are recorded by the recording heads 112K, 112C, 112M, and 112Y.

Next, in step S210, defective pixels are detected using the defective pixel detection device 136 disposed in the stage after the recording heads 112K, 112C, 112M, and 112Y. As a result, when defective pixels are detected, information indicating the frame in which defective pixels have been detected is held in the controller (not shown) of the image recording apparatus 100 in the next step S220.

Regardless of whether defective pixels have been detected, a loop portion 148 is formed in the next step S230 in an area that follows the defective pixel detection device 136, and the recording paper 116 is held on standby in a continuous form without being cut until the processing of a single order is complete.

Next, in step S240, a determination is made as to whether the processing of a single order is complete. As a result, when the processing of a single order is not yet complete, the process returns to step S200, and the next image in the single order is recorded.

When processing has been completed for a single order, a determination is made in the next step S250 as to whether defective pixels have been detected. This is due to the fact that information indicating that defective pixels have been detected is held together with the frame information in the controller of the image recording apparatus 100, so a determination is made based on this information. When no defective pixels have been detected at all in a single order, the process immediately advances to step S270, and the images (frames) for a single order are cut as a batch.

When it is determined in step S250 that defective pixels have been detected in a single order, the single order is returned and the defective pixels are restored by being recorded a second time in the following step S260. In other words, the recording paper 116 for a single order that is fashioned into a loop portion 148 and kept in standby mode in the stage after the recording unit 112 is conveyed and returned to the stage prior to the recording head 112, and a loop portion 150 composed of the images for a single order is formed.

The recording paper 116 from the loop portion 150 is passed through the recording unit 112 for a second time while re-recording is performed solely to the images in which defective pixels have been detected on the basis of the defective pixel detection information in the controller (not shown) and on the basis of the accurate positions detected a second time by the defective pixel position detection device 144. This recording method is the same as the method of the first embodiment. However, at this embodiment, the recording paper 116 is in a continuous state, so a technique suitable to this option must be adopted. In certain cases, it is possible to adopt an arrangement in which the recording paper 116 held on standby as a loop portion 148 is returned to the loop portion 150, restorative action is performed on the defective nozzles, and the recording paper 116 is conveyed in the same manner as the previous cycle while recording the defective pixels with the same nozzles that have been restored.

In this manner, once the restoration of defects in one order is complete, this order is cut as a batch into frame-by-frame images with the cutter 146. The frame-by-frame images (prints) are stored on a prescribed shelf 122*a* of the discharge unit 122, and each order is discharged as a batch.

Thus, in the present invention, each order is processed as a batch, so the images (printed matter) of a single order can be prevented from being disordered.

The image recording apparatus of the present invention was described above in detail, but the present invention is not limited to the above embodiments, and various improvements and modifications may naturally be carried out within the scope that does not depart from the spirit of the present invention.

What is claimed is:

1. An image recording apparatus which records an image to a recording medium with a full-line recording head in which a plurality of image-recording elements are arrayed across a length that corresponds to an entire width of the recording medium while at least one of the recording medium and the recording head is conveyed in a direction that is substantially orthogonal to a width direction of the recording medium, and the recording head and the recording medium are relatively moved, the image recording apparatus comprising:

a defective pixel detecting device which detects defective pixels in the image recorded on the recording medium by the recording head;

a recording medium conveying device which conveys the recording medium on which the defective pixels have been detected, to a position for re-recording the image with the recording head when the defective pixels have been detected in the image recorded on the recording medium; and a defective pixel position detecting device which detects positions of the defective pixels before re-recording the image with the recording head on the recording medium on which the defective pixels have been detected, wherein, when the defective pixels are detected, the defective pixels on the recording medium are restored by moving at least one of the recording head and the recording medium, and re-recording the pixels in the detected defective pixel positions by using different image-recording elements than the image-recording elements that have recorded the defective pixels, or by repairing defects of the image recoding elements which have recorded the defective pixels, and re-recording the image.

2. The image recording apparatus according to claim 1, wherein pixels surrounding the defective pixels are printed to interpolation when the re-recording is performed on the recording medium with the recording head.

3. The image recording apparatus according to claim 2, wherein the pixels surrounding the defective pixels are printed to interpolation with a density that is less than the density during the previous recording.

4. The image recording apparatus according to claim 3, further comprising: a relative position varying device which varies relative positions of the recording medium and the recording head in array direction of the image-recording elements when the re-recording is performed on the recording medium with the recording head.

5. The image recording apparatus according to claim 2, further comprising: a relative position varying device which varies relative positions of the recording medium and the recording head in array direction of the image-recording elements when the re-recording is performed on the recording medium with the recording head.

6. The image recording apparatus according to claim 1, further comprising: a relative position varying device which varies relative positions of the recording medium and the recording head in array direction of the image-recording elements when the re-recording is performed on the recording medium with the recording head.

7. The image recording apparatus according to claim 1, further comprising:

a discharge unit to which the recording medium having been recorded with the image is discharged; and a standby unit to which the recording medium having been recorded with the image with no defective pixels is discharged, the standby unit being disposed at the discharge unit, wherein the defective pixel detecting device detects defective pixels on an already recorded recording medium, and stores temporarily the recorded recording medium with no defective pixels in the standby unit, whereas restores the recorded recording medium on which defective pixels have been detected, integrates the restored recording medium and the recorded recording medium which stored in the standby unit, and discharges the recorded recording media as a batch.

* * * * *